US006345781B1

(12) United States Patent
Bowers

(10) Patent No.: US 6,345,781 B1
(45) Date of Patent: Feb. 12, 2002

(54) PAYOFF APPARATUS

(75) Inventor: Carl W. Bowers, Virginia Beach, VA (US)

(73) Assignee: Metal Accessories, LLC, Suffolk, VA (US)

( * ) Notice: Subject to any disclaimer, the term of this patent is extended or adjusted under 35 U.S.C. 154(b) by 0 days.

(21) Appl. No.: 09/626,849

(22) Filed: Jul. 27, 2000

(51) Int. Cl.[7] ..... B65H 16/02; B65H 23/06; B65H 75/24

(52) U.S. Cl. ..... 242/422.4; 242/574.4; 242/598.4

(58) Field of Search ..... 242/422.4, 574.4, 242/598.4

(56) References Cited

U.S. PATENT DOCUMENTS

| | | | | | |
|---|---|---|---|---|---|
| 987,480 | A | * | 3/1911 | Morton | 242/574.4 |
| 1,075,051 | A | * | 10/1913 | Miller | 242/422.4 |
| 2,218,352 | A | * | 10/1940 | Fischer | 242/598.4 |
| 3,421,712 | A | * | 1/1969 | Scroggie et al. | 242/574.4 |
| 3,720,383 | A | * | 3/1973 | Crawford | 242/422.4 |
| 4,151,900 | A | * | 5/1979 | Kirwan | 242/422.4 |
| 4,278,112 | A | * | 7/1981 | Takahashi | 242/574.4 |

* cited by examiner

*Primary Examiner*—John M. Jillions

(57) ABSTRACT

A self-adjusting payoff comprising a frame, and a pivoting spool mounted in the frame. The pivoting spool comprises an axle, at least three pivot assemblies slideably mounted on the axle and an adjustment mechanism for adjusting the location of the pivot assemblies relative to the axle. Each of the pivot assemblies comprises a pair of freely rotating, parallel arms extending radially from the axle toward and rotatably attached to coil supports that, when the pivoting spool is adjusted to its most extended position as described hereinafter, extend parallel to the axle. Operation of the adjustment mechanism causes movement of the extremities of the parallel arms proximate the axle to move inward or outward along the axle thereby adjusting the relative distance between the axle and the supports permitting acceptance of variously sized coils by the payoff. Independent pivoting of each of the pivot assemblies allows for self adjustment of the orientation of a coil mounted horizontally on the payoff to the position of least resistance as material is drawn off of the payoff and into guides or other vertically offset locations.

4 Claims, 5 Drawing Sheets

PAYOFF APPARATUS

FIELD OF THE INVENTION

The present invention relates to payoff or uncoiling devices for coiled metal strip and more particularly to such a device for feeding metal strip into vertically offset guide arrangements.

BACKGROUND OF THE INVENTION

Numerous devices have been developed for forming, especially roll-forming, of metallic strip. Many of these devices utilize metal fed from a coil mounted horizontally at the front or entry end of the metal forming equipment. A large number of arrangements and devices have been suggested for mounting and controlling such coiled material to obtain a uniform, smooth and non-binding metal feed into the forming equipment. In general, the coil is mounted horizontally to avoid telescoping resulting when a coil of metal is mounted at even a slight angle and no lateral or end-of-coil support is provided. The presence of end caps on coil supports to prevent telescoping, however, can and often does result in damage to the outer edges of the coil if uncoiling is not perfectly aligned with the end caps.

U.S. patent application Ser. No. 09/546,424 filed Oct. 4, 1999 now U.S. Pat. No. 6,282,935 describes one such metal forming device that presents a different, but not uncommon, requirement for the uncoiling of metal introduced into the roll-forming device. This equipment is a small, portable metal flashing forming devices that requires that the metal being uncoiled enter a pair of parallel but vertically offset edge guides within a relatively short distance (less than about 24") of the uncoiling metal. This arrangement places lateral strains on the uncoiling metal strip and can result in crimping or other unacceptable deformation of the incoming metal strip unless great care is taken. The use of horizontally mounted payoff coils that include end caps results in binding of the metal as it comes off of the coil and damage and marring of the edges of the strip as it is forced, i.e. twisted from horizontal to attain the vertically offset configuration required to enter the parallel but vertically offset edge guides.

Thus, the availability of a payoff device that would permit pivoting of the incoming metal strip as it leaves the supply coil and enters the parallel but vertically offset edge guides would be very useful in ensuring the quality and shape of flashing produced buy such a device while simultaneously simplifying the operation of such a device by eliminating the care that must be taken to assure proper feed of the metal strip to the edge guides.

SUMMARY OF THE INVENTION

According to the present invention, there is provided a strip payoff device that allows a coiled strip mounted thereon to "pivot" or rotate slightly to better address introduction of the strip into, for example, parallel but vertically offset edge guides located at a relatively small distance from the strip payoff. Allowing the coiled material to pivot eliminates the tendency of the strip, particularly metal strip, to crimp or otherwise bind as it enters the proximately located edge guides.

The payoff of the present invention comprises a frame, and a pivoting spool mounted in the frame. The pivoting spool comprises an axle, at least three pivot assemblies slideably mounted on said axle and an adjustment mechanism for adjusting the location of the pivot assemblies relative to the axle. Each of the pivot assemblies comprises a pair of freely rotating, parallel arms of equal length extending radially from the axle toward and rotatably attached to coil supports that, when the pivoting spool is adjusted to its most extended position as described hereinafter, lie parallel to the axle. Operation of the adjustment mechanism causes movement of the extremities of the parallel arms proximate the axle to move inward or outward along the axle thereby adjusting the relative distance between the axle and the supports permitting acceptance of variously sized (diameter) coils by the payoff. Independent pivoting of each of the pivot assemblies allows for self adjustment of the orientation of a coil mounted on the payoff to the position of least resistance as material is drawn off of the payoff and into guides or other vertically offset locations.

DETAILED DESCRIPTION

Figure 1:
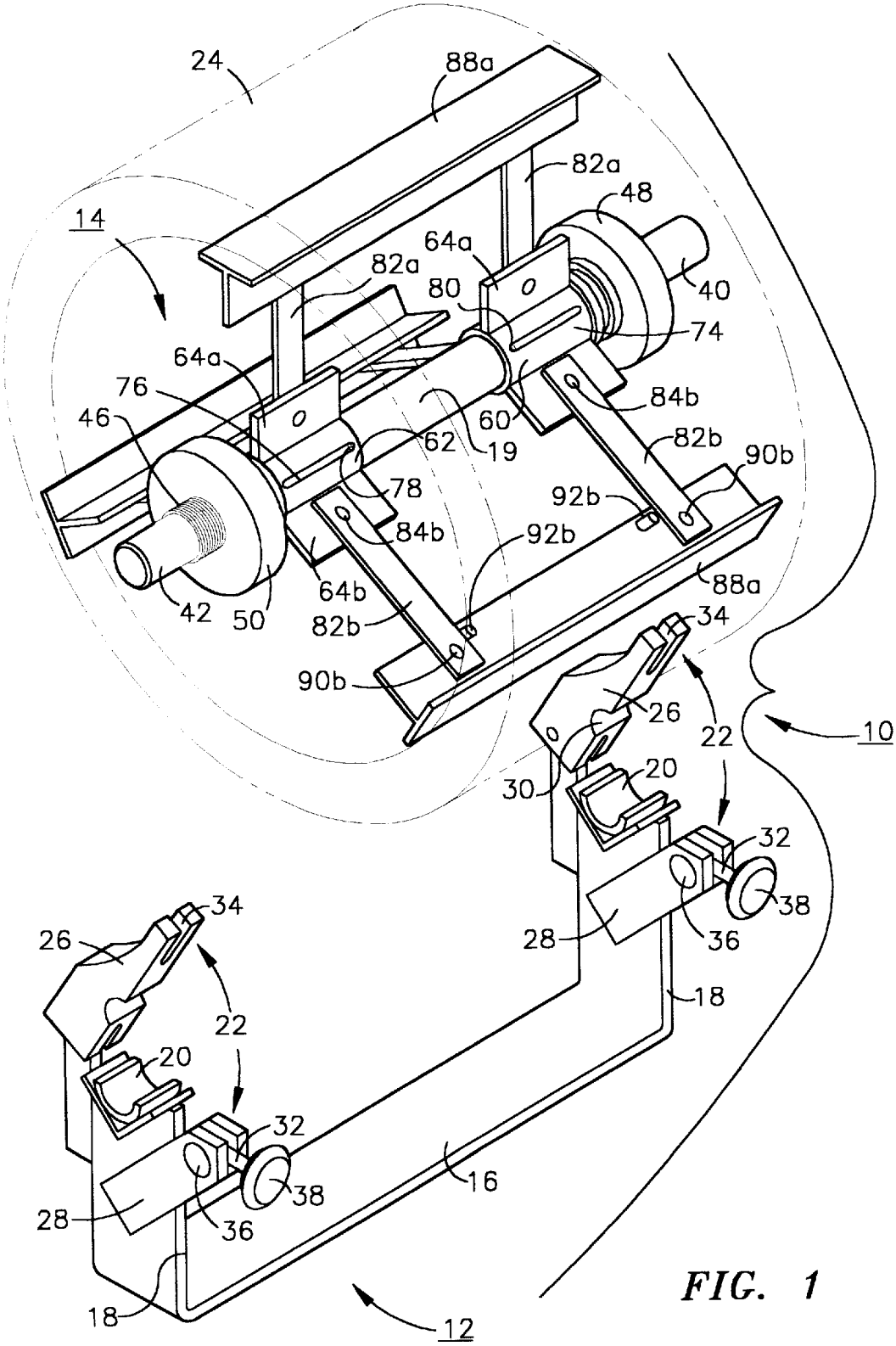
FIG. 1 is a blown apart perspective view showing the pivoting spool and support frame of the payoff of the present invention.
Figure 2:
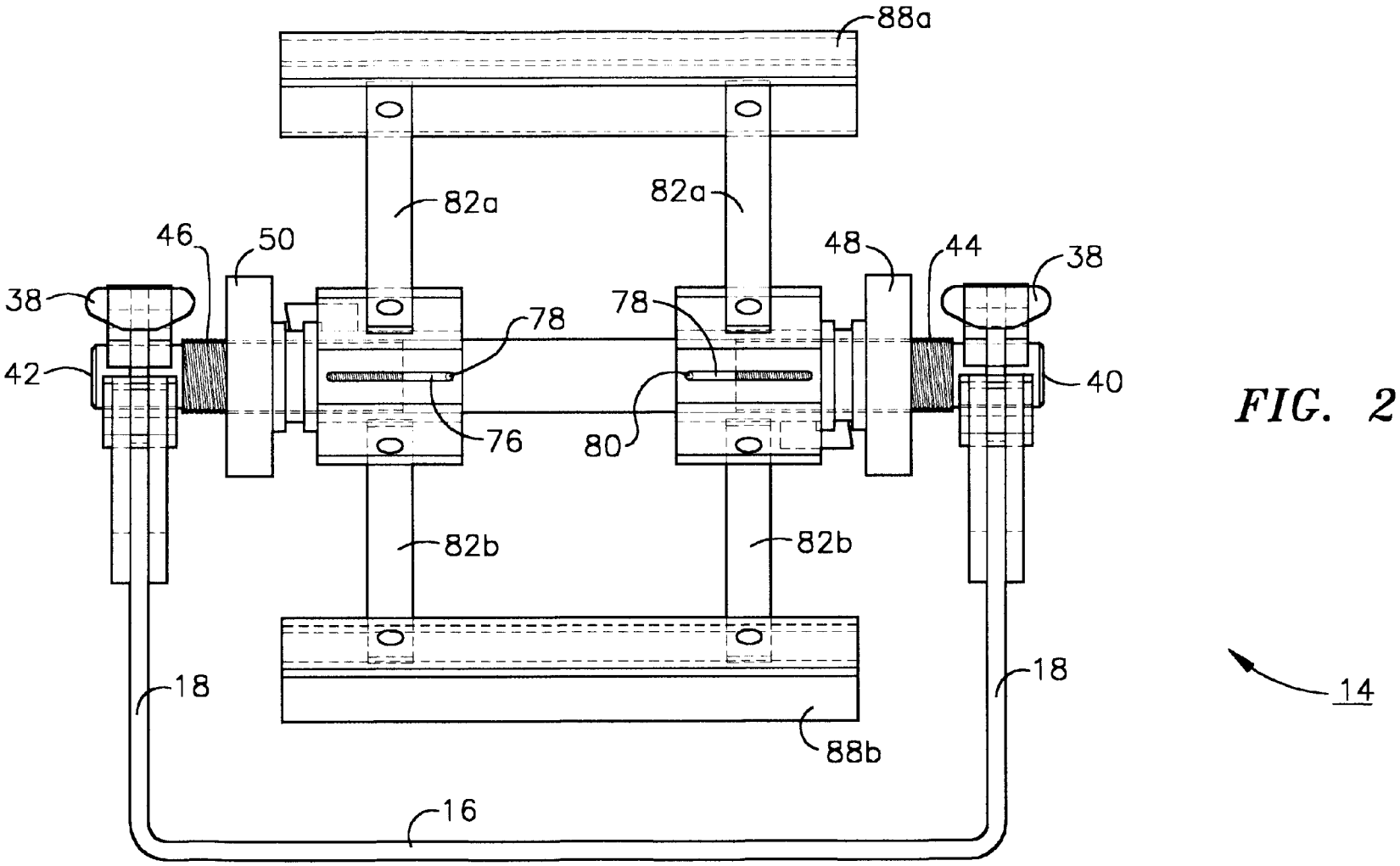
FIG. 2 is a partially phantom end view of the pivoting spool of the present invention.

Referring now to FIG. 1, the payoff 10 of the present invention comprises a supporting frame 12 and a pivoting spool 14. Supporting frame 12 may be of any design so long as it provides controlled payout of strip from a coil 24 mounted on pivoting spool 14. Supporting frame 12 depicted in FIG. 1, comprises a base 16 and a pair of vertically extending parallel arms 18. Atop each of parallel arms 18 is a bearing 20. In the case depicted in FIG. 1, bearing 20 is a simple polymeric arch sized to receive an axle 19 placed therein and to permit low speed rotation thereof In order to assure that axle 19 does not inadvertently extricate itself from bearing 20, some type of locking or securing mechanism 22 is preferably provided. Locking mechanism 22, in addition to securing axle 19 in place atop parallel arms 18 also serves as a brake, controlling the rotation of axle 19 thereby preventing a coil 24 of, for example metal, mounted on pivoting spool 14 from "springing" or expanding as such configurations of metal strip are prone to do when left unconstrained or secured.

In the embodiment depicted in FIG. 1, locking mechanisms 22 each comprise rotating latches 26 and 28. When depressed, i.e. rotated downward, recesses 30 in latches 26 engage the extremities of axle 19. Upward rotation of latches 28 then permits engagement of threaded shafts 32 with slots 34 in latches 26 by rotation of threaded shafts 32 about axles 36 through which they are threaded. Turning of threaded shaft heads 38 then permits tightening of locking/braking mechanisms 22 and adjustment of the amount of tension placed on axle 19 and concomittantly coil 24 mounted on pivoting spool 14.

The core of the improved payoff of the present invention is pivoting spool 14. As shown in the various Figures, but initially, FIG. 1, pivoting spool 14 comprises an axle 19 having extremities 40 and 42. Inboard of extremities 40 and 42 are threaded portions 44 and 46 located adjacent each of extremities 40 and 42. Threaded over threaded portions 44 and 46 are adjustment wheels 48 and 50 that move laterally along axle 19 when they are turned and threads 52 and 54 at the interior of adjustment wheels 48 and 50 engage threaded portions 44 and 46. According to the particular embodiment depicted in the drawings, adjustment wheels 48 and 50 also include attached annular grooves 56 and 58 integral with adjustment wheels 48 and 50.

Figure 3:
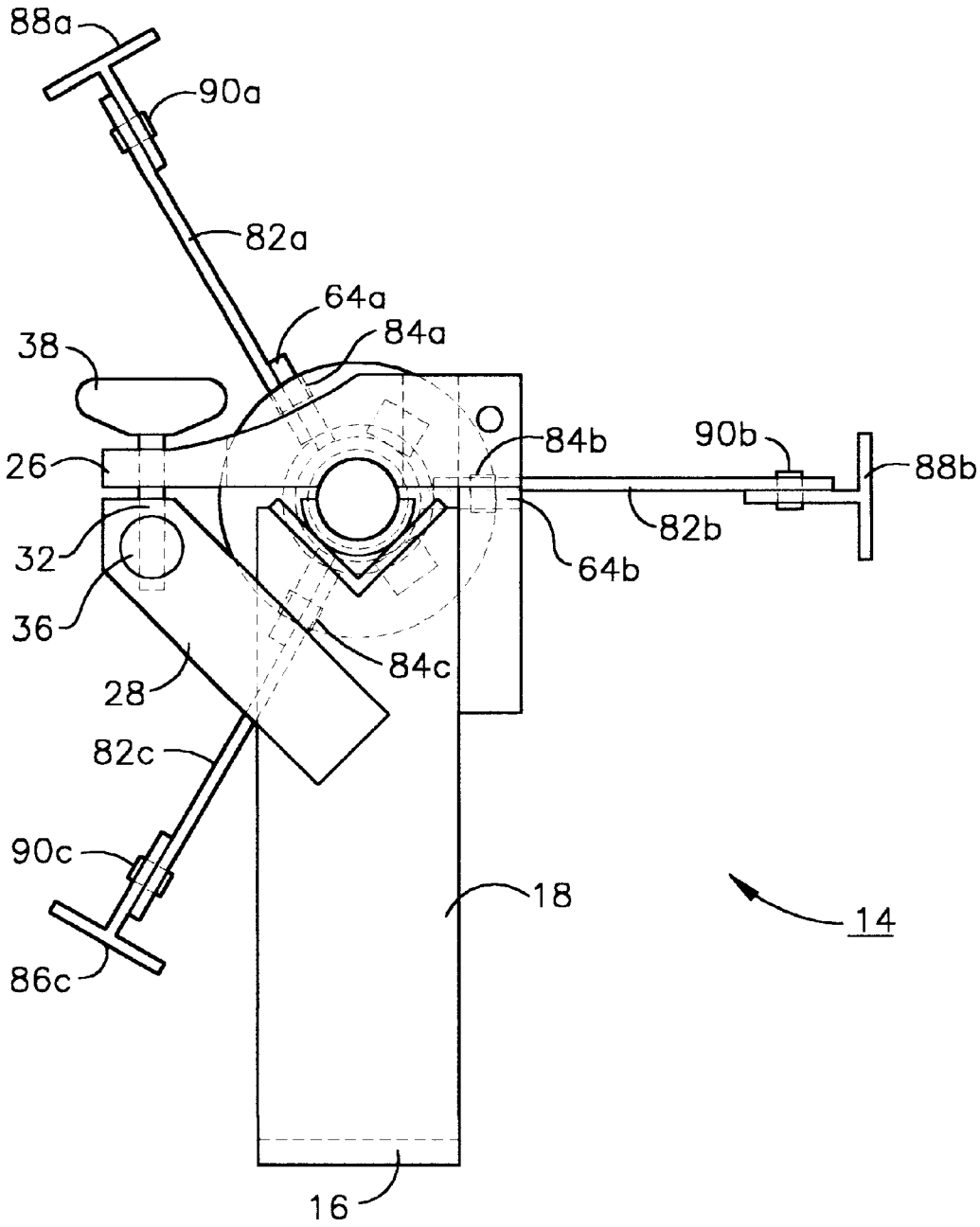
FIG. 3 is a partially phantom side view of the pivoting spool of the present invention.

Inboard of adjustment wheels 48 and 50 are annular collars 60 and 62 having at least three flanges 64*a,* 64*b* and 64*c* extending radially at angles of about 120° therefrom as best seen in FIG. 3. Annular collars 60 and 62 slide axially and freely along the surface of axle 19. The axial motion of annular collars 60 and 62 is controlled by the presence of tabs 66 and 68 that extend axially and outwardly from annular collars 60 and 62 and ends 70 and 72 of tabs 66 and 68 engage annular grooves 56 and 58 that form parts of adjustment wheels 48 and 50. Tabs 66 and 68 can be welded to annular collars 60 and 62 or formed integrally therewith as is machined or cast parts. Thus, as adjustment wheels 48 and 50 are turned and threads 52 and 54 advance or retreat over engaging threads 44 and 46 on axle 19, annular collars 60 and 62 are caused to move axially along axle 19 through the engagement of ends 70 and 72 with annular grooves 56 and 58. Annular collars 60 and 62 are also preferably provided with slots 74 and 76 that engage stops 78 and 80 that extend axially from axle 19. The combination of stops 78 and 80 in slots 74 and 76 respectively limit the axial travel of collars 60 and 62 assuring that they cannot be removed, even accidentally, from axle 19.

As will be obvious to the skilled artisan, more than three flanges may be extended from annular collars 60 and 62 to provide the coil support required. Whatever number of such elements are utilized the structure should be such as to not interfere with the operation of the pivoting spool as described herein.

Extending generally radially from and attached rotatably to flanges 64*a,* 64*b* and 64*c* are arm pairs 82*a,* 82*b* and 82*c*. All of arm pairs 82*a,* 82*b* and 82*c* are preferably of equal length. According to the embodiment depicted in the drawings, arm pairs 82*a,* 82*b,* and 82*c* are attached to flanges 64*a,* 64*b* and 64*c* by the simple expedient of penetrating pins 84*a,* 84*b* and 84*c* that pass through flanges 64*a,* 64*b* and 64*c* and arm pairs 82*a,* 82*b* and 82*c* allowing arm pairs 82*a,* 82*b* and 82*c* to freely rotate about penetrating pins 84*a,* 84*b* and 84*c*. Although in the embodiment depicted in the Figures, each of arm pairs 82*a,* 82*b* and 82*c* is shown as comprising two arms located on either side of flanges 64*a,* 64*b* and 64*c* a single member may be substituted for the two arm structure so long as appropriate rotational freedom is retained. For example, a cold rivet or other suitable fastener may be used for this purpose.

Figure 4:
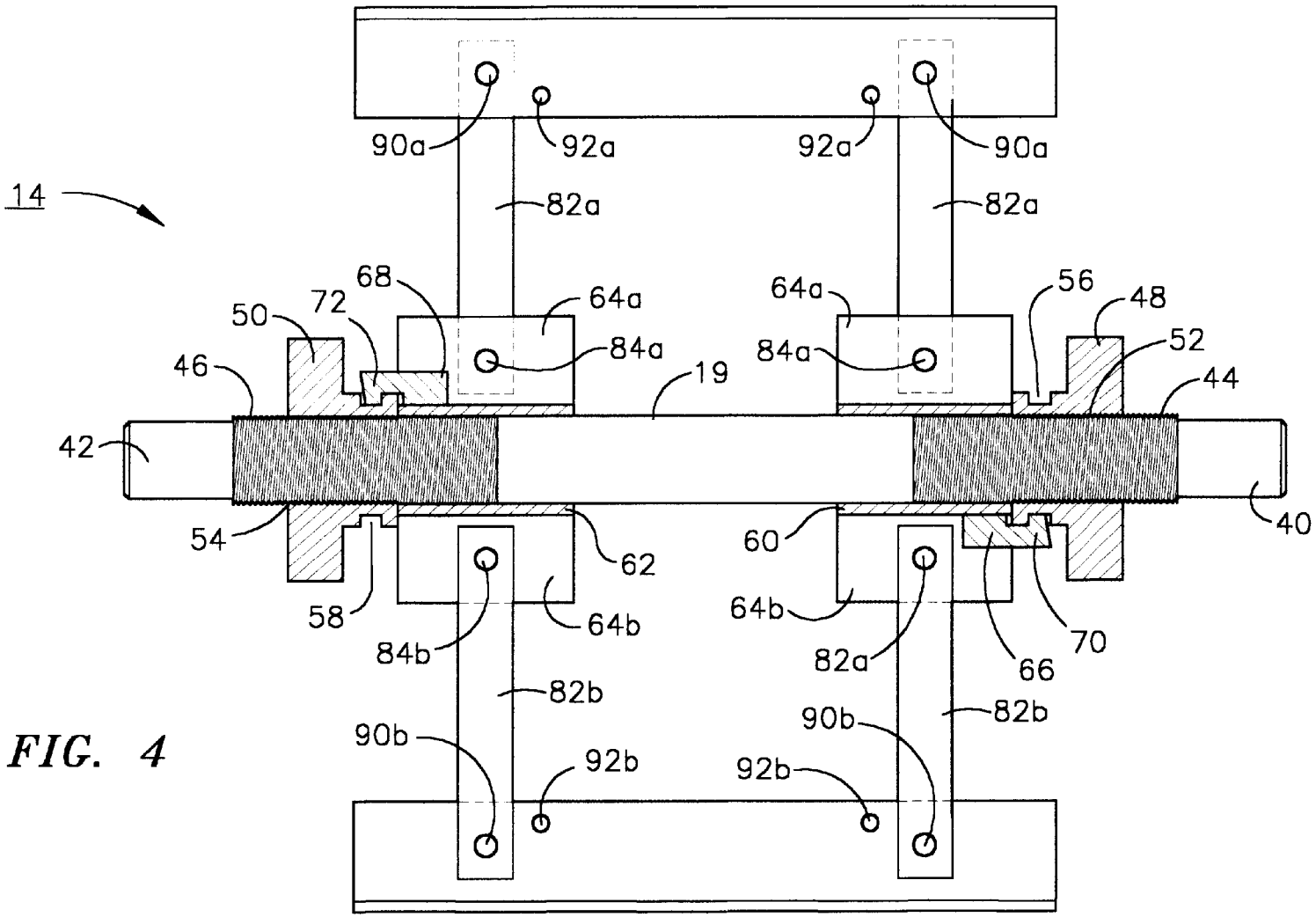
FIG. 4 is partially cutaway top view of the pivoting spool of the present invention in its most extended position.
Figure 5:
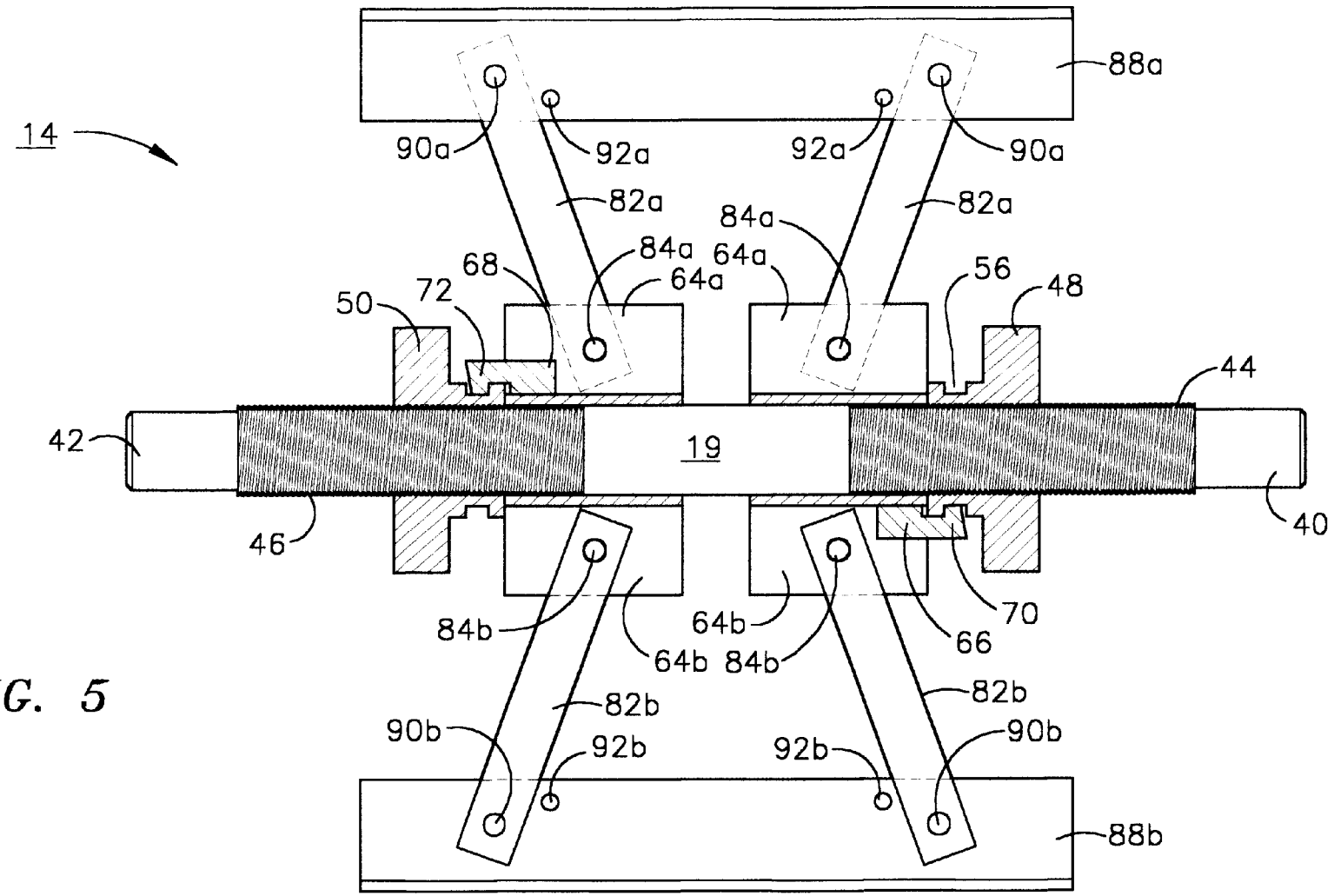
FIG. 5 is a partially cutaway top view of the pivoting spool of the present invention in an intermediate extended position.

At the outer extremities 86*a,* 86*b* and 86*c* of arm pairs 82*a,* 82*b* and 82*c* are coil supports 88*a,* 88*b* and 88*c* that are similarly rotatably attached to arm pairs 82*a,* 82*b* and 82*c* by penetrating pins 90*a,* 90*b* and 90*c*. In their fully extended position from axle 19 as shown in FIG. 4, or their most closed position as shown in FIG. 5, coil supports 88*a,* 88*b* and 88*c* lie parallel to axle 19, but as will be explained below, they may, depending upon the location of adjustment of adjustment wheels 48 and 50, assume positions angularly disposed to axle 19. Coil supports 88*a,* 88*b* and 88*c* also preferably incorporate stop pairs 92*a,* 92*b* and 92*c*. These elements inhibit excessive rotation and consequent collapse of coil supports 88*a,* 88*b* and 88*c* against axle 19. As will be apparent to the skilled artisan, a number of other similar expedients may be utilized to accomplish the same result. For example, similar stops (not shown) could be incorporated in flanges 64*a,* 64*b* and 64*c* at the base of arm airs 82*a,* 82*b* and 82*c* to similarly inhibit excessive travel and hence collapse of coil supports 88*a,* 88*b* and 88*c* against axle 19. Coil supports 88*a,* 88*b* and 88*c* are preferably sized to fit the width of the particular coil 24 applied thereto.

It is this capability of payoff apparatus 10 of the present invention to assume angularly disposed relationships with respect to axle 19 that provides the flexibility needed to permit applied coil 24 to assume an angular position relative to axle 19. This flexibility allows strip material removed from coil 24 to enter a pair of parallel but vertically offset edge guides proximate payoff 10 without buckling or otherwise. The flexibility of payoff 10 imparted by the rotatable attachment of arm pairs 82*a,* 82*b* and 82*c* to flanges 64*a,* 64*b* and 64*c* and coil supports 88*a,* 88*b* and 88*c* permits payoff 10 to self adjust to orient coil 24 at the optimum angle to permit removal of strip from coil 24 with minimum resistance and buckling or bending.

In use, the payoff apparatus of the present invention is utilized by locating frame 12 at the entry end of a suitable metal strip forming device. Pivoting spool 14 is inserted into the center of a suitable coil of metal after adjustment wheels 48 and 50 have been threaded inward as far as they can travel against stops 78 and 80 as shown in FIG. 5, which presents the narrowest diameter of extension for pivoting spool 14. Coil 24 is then centered upon coil supports 88*a,* 88*b* and 88*c* and adjustment wheels 48 and 50 then screwed outwardly, preferably in unison until coil supports 88*a,* 88*b,* and 88*c* push securely against the inner surface of coil 24. Pivoting spool 14 with coil 24 mounted thereon is then inserted into frame 12 as shown in FIG. 3 and locking/braking mechanisms 22 tightened as described hereinabove to the appropriate tightness to allow controlled removal of strip from coil 24. Because of the free rotational structure of arm pairs 82*a,* 82*b,* and 82*c* with respect to flanges 64*a,* 64*b* and 64*c* and coil supports 88*a,* 88*b,* and 88*c* pivoting spool 14 self adjusts to the appropriate angle relative to axle 19 to permit nonbinding removal of metal strip from coil 24 into parallel but vertically offset guides. The self adjusting capability of pivoting spool 14 allows coil 24 to be controllably angularly displaced with respect to axle 19. In this fashion, metal strip can be drawn from coil 24 with no tendency for the metal to be distorted by lateral forces that would normally be applied to the metal from coil 24 as it is pulled from a true horizontal position to a somewhat tilted toward the vertical position as would be required to properly enter a pair of parallel but vertically offset edge guides.

As the invention has been described, it will be apparent to those skilled n the art that the same may be varied in many ways without departing from the spirit and scope of the invention. Any and all such modifications are intended to be included within the scope of the appended claims.

What is claimed is:

1. A self-adjusting payoff comprising:

A) a frame; and

B) a pivoting spool mounted in said frame and comprising:

1) an axle having opposing extremities;

2) threaded portions proximate each of said opposing extremities;

3) adjustment wheels having interior threads rotatably engaging said threaded portions and including axial extensions incorporating an annular groove;

4) a pair of annular collars slideably about said axle intermediate said adjustment wheels and including tabs that engage said annular grooves;

5) at least three arm pairs having opposing ends extending radially from and attached rotatably to said annular collars at one of said opposing ends; and 6) at least three coil supports rotatably attached to the other of said opposing ends thereby joining each of said arm pairs.

2. The self-adjusting payoff of claim 1 wherein said arm pairs are of equal length.

3. The self-adjusting payoff of claim 1 wherein said frame includes a pair of bearings for receipt of said opposing ends of said axle and a braking mechanism for controlling the speed of rotation of said axle.

4. The self-adjusting payoff of claim 3 wherein said braking mechanism comprises a slotted bracket that rotates over said bearing and said axle, and a threaded locking bolt that rotatably engages said slot.

* * * * *